US006052844A

United States Patent [19]

Walsh et al.

[11] Patent Number: 6,052,844

[45] Date of Patent: Apr. 25, 2000

[54] WHIRLPOOL BATH ASSEMBLY

[75] Inventors: Michael Patrick Walsh, Ballykillaboy; Michael Hennessy, Dublin, both of Ireland

[73] Assignee: Faiso Limited, Dublin, Ireland

[21] Appl. No.: 09/018,944

[22] Filed: Feb. 5, 1998

[30] Foreign Application Priority Data

Feb. 5, 1997 [IE] Ireland ..... S970070
Oct. 14, 1997 [IE] Ireland ..... S970746

[51] Int. Cl.[7] ..... A47K 3/00

[52] U.S. Cl. ..... 4/541.1; 4/541.6; 4/541.3

[58] Field of Search ..... 4/541.1, 541.3, 4/541.4, 541.5, 541.6, 546

[56] References Cited

U.S. PATENT DOCUMENTS

| | | | |
|---|---|---|---|
| 3,890,655 | 6/1975 | Mathis | 4/178 |
| 4,358,862 | 11/1982 | Altman et al. | 4/542 |
| 4,408,721 | 10/1983 | Cohen et al. | 239/417 |
| 4,542,854 | 9/1985 | Mathis | 239/587 |
| 4,829,607 | 5/1989 | Huse | 4/541.1 |
| 4,954,179 | 9/1990 | Franninge | 4/541.1 |
| 5,279,003 | 1/1994 | Gape et al. | 4/541.6 |
| 5,546,617 | 8/1996 | Sandrin | 4/541.6 |

FOREIGN PATENT DOCUMENTS 0445504 9/1991 European Pat. Off. .

*Primary Examiner*—David J. Walczak
*Attorney, Agent, or Firm*—Jacobson, Price, Holman & Stern, PLLC

[57] ABSTRACT

A whirlpool bath assembly with a recirculation pump fed from the bath by a suction pipe and then to venturi jet units through by system feed pipes. Further air pipes feed the venturi jet units. A drain-off valve connects the pump through a drain pipe to a waste-water drain. All the units forming the assembly are constructed so as to provide a gravity drain-off into the bath and drain pipe. This is done by ensuring that height of the surfaces over which drain-off water flows when the assembly is inoperative reduce continuously without forming any water retaining recesses.

25 Claims, 12 Drawing Sheets

WHIRLPOOL BATH ASSEMBLY

BACKGROUND OF THE INVENTION

1. Field of the Invention

The present invention relates to whirlpool bath assemblies. In particular the invention relates to a whirlpool bath assembly comprising a pump recirculation unit, a suction system pipe having an inlet for mounting in a bath and outlet feeding the pump recirculation unit, a venturi jet unit having a water supply inlet, an air inlet and a combined air and water outlet, venturi mounting means for securing the venturi jet unit to a bath side wall, a system feed pipe between the pump recirculation outlet and the venturi, a drain-off valve connected to the pump a waste-water pipe fed from the drain-off valve and a control unit.

2. Background Information

Whirlpool systems have become increasingly popular and this has led to the retro-fitting of these into domestic baths and in baths of hotels or similar establishments. Typically these systems are made from a large number of components which, unless they are very carefully designed, could have numerous places where water will remain after cutting off the whirlpool and draining the bath. Many so-called self-draining systems are so made as to have a large number of pockets within which water can be retained. For example, water can be retained in bends in the system pipes, in the water recirculating pump, in the venturi jet units and indeed in all the components: very often the connection of one component to another forms a water retaining pocket or recess.

Heretofore such whirlpool baths or jacuzzis were effectively luxury items and little attention was paid to the design, or more particularly the technical aspects. This has led to whirlpool assemblies with a large number of parts and it is recognised that in any plumbing equipment the more parts that have to be joined together the more likely it is that there will be leaks in the system since each part joined together is a potential for a leak, no matter how good the sealing and fitting is.

For example, U.S. Pat. No. 4,358,862 (Altman et al) concentrates on the provision of better connections so that the air and water supply channels can be made from continuous tubing. This was one attempt to obviate the need for additional connections such as elbows and T-fittings which increases construction time and cost. A considerable amount of work has concentrated on the control aspects of the whirlpool bath such as described in U.S. Pat. No. 4,542,854 (Mathis). The same inventor is the patentee in respect of earlier improvements in the general construction of whirlpool jets as shown in U.S. Pat. No. 3,890,655 (Mathis). Again U.S. Pat. No. 4,408,721 (Cohen et al) is another attempt to improve what can be best described as the operational and technical efficiency of such whirlpool baths or jacuzzis. However, none of these specifications do more than tackle minor technical problems relating either to general plumbing arrangements, or to the actual efficiency of the units themselves.

A further problem with such whirlpool assemblies which has been recognised for a long time is the problem of hygiene and thus infection. Since by their very nature whirlpool baths utilise hot water, they are therefore warm and moist and provide a fertile breeding ground for disease causing organisms including Legionella bacteria which can cause the sometimes fatal Legionnaires disease and number of less dangerous though still serious diseases such as Pseudomonas which can cause severe skin rashes, ear infections and even pneumonia. In spite of claims that disinfectants can cure this and it has long been proposed by back-flushing with disinfectant, etc., they have heretofore proved to be relatively inefficient. Undoubtedly the use of disinfectants is to be applauded, however, by far the best way is prevention i.e. if the whirlpool assembly can be kept free of stagnant water and clean at all times, then the possibility of disease is greatly reduced.

There have been may so-called self-draining systems most of which do not work. What are often called self-draining Systems are those which retain somewhat of the order of 30 ml of water. One glass of water per system is common in most of the world as being acceptable and claims to less than this such as "an egg cup full" have appeared in sales literature. It is a long recognised problem with heretofore no solution and from the terminology used little scientific analysis. Such that the public will understand quantities of water even if the volume corresponding to such terms is indeterminate. One of the most important places to have the assembly self-draining is within the venturi jet unit itself. Indeed in European Patent Specification No. 0 445 504 (Ucosan BV) there is illustrated a venturi jet unit, which, if correctly assembled and made could be self-draining. It is partly self-draining, but is not self-draining for certain obvious reasons. Firstly, the water retained in the inlet pipes to this venturi jet unit would have to drain back to the pump. This would require that the venturi jet units be placed in a position higher than the top of the pump, which will negate the whole benefit of such a design as the objective is to get the venturi jets as low as possible within the bath to optimise the massaging effect of the venturi jet units. Indeed it has to be admitted that this venturi jet unit could be modified to provide a self-draining venturi jet unit, however, it is submitted that it is not envisaged by this patent specification. Essentially any self-draining venturi jet unit must be designed to accommodate the differing bath wall thicknesses and the varying slope of the bath. In any case the problem is not in the design of individual parts of a whirlpool assembly but in producing a composite assembly that is totally self-draining.

OBJECTS

The present invention is directed towards overcoming some of the disadvantages in present assemblies and providing a more efficient assembly that can be easily retrofitted to existing baths and that further will be hygienically acceptable.

The present invention is also directed towards providing such a whirlpool system which can be used in conventional bath tub installations. However, the invention is not restricted to such installations.

The main object of the present invention is to ensure that a whirlpool assembly can be provided in which for all practical purposes, there will be no residual water retained therein after the unit has been switched off.

SUMMARY OF THE INVENTION

According to the invention there is provided a whirlpool bath assembly comprising:

a venturi jet unit including a main body having an elongate bore between the water supply inlet and a combined water and air supply outlet, a venturi throat of restricted cross-sectional area within the bore, an air duct feeding between an air inlet and outlet in the venturi throat, venturi mounting means for securing the main body to the bath sidewall, whereby the height of all surfaces contactable by water and over which water would flow on shutting off operation of the assembly reduce continuously in the direction of such flow without forming any water retaining pockets, a pump recirculation unit having an outlet and an inlet the surfaces of the pump being so arranged so that water will flow on shut-off by gravity from outlet to inlet without lodging in any recesses, a system suction pipe having an inlet for mounting in the bath and an outlet for feeding the pump inlet, the pipe sloping downwards from inlet to outlet without the formation of water retaining recesses, a system feed pipe between the water supply inlet of the venturi jet unit and the outlet of the pump recirculation unit, the feed pipe configured to drain into either the venturi unit or the pump recirculation unit on shutting off of the whirlpool assembly, the configuration being such as to further avoid the formation of water retaining recesses, a drain-off valve connected to the pump recirculation unit, and a waste-water pipe connecting the drain off valve to a bath waste-water drain in the waste-water pipe sloping downwardly from the drain-off valve to the bath waste-water drain without the formation of water retaining recesses.

The advantage of this is that by a careful choosing of components and the manner in which they are arranged the whirlpool assembly is truly self-draining, something that has not heretofore been achieved.

Further the invention provides a whirlpool bath assembly in which the main body is a two part body one part comprising a collar abutting around a mounting hole in the bath sidewall and projecting therethrough to form portion of the main bore, the remainder of the main body being formed by a part totally behind the bath sidewall. The advantage of this is that one can have the optimum size of bore for water and air supply while at the same time being able to fit the unit with the smallest possible hole in the bath and thus it is possible to provide the least obtrusive face plate or collar to mount the venturi jet unit within the bath sidewall.

Further the angle subtended by the elongate bore of the venturi and the bath sidewall is between 15° and 50°. These are quite substantial angles for a venturi unit to subtend and show that the present invention can adapt to any shape of bath wall and in particular any slope of bath wall.

Preferably the whirlpool bath assembly comprises:

a ball-shaped outlet jet for mounting on the venturi main body adjacent the outlet having a central passageway for communicating with the elongate bore; and a downwardly inclined drain-off passageway connecting the elongate bore to the bath.

Having a drain-off passageway gets over one of the major problems of ball-shaped outlet jets which are notorious for retaining water and are a major source of infection and disease.

Further to ensure that the whirlpool bath assembly is self-draining there is provided a drain-off valve which comprises:

a valve body having an upper inlet bore connected to the suction pipe and a lower outlet bore connected to the waste-water pipe;

a valve disc movable between a position closing the inlet to a position closing the outlet;

biasing means for urging the valve disc into the position closing the inlet;

a drain-off channel in the valve body communicating between the inlet bore and the interior of the valve body above the valve disc; and a drain-off hole through the disc defining a water passageway between the inlet bore and the outlet when the disc is in its position closing the inlet bore and sealing against the valve body when the disc is in its position closing the outlet bore.

The advantage of this valve is that the valve will close when the unit is operating and will open when its shuts off, to allow a bleed-off of any water that may be in the pump or any other parts of the unit. At the same time it will prevent a blow-back of water.

Ideally all water and air contacting surfaces are on components of a plastics material incorporating an anti-bacterial agent. Obviously any form of anti-bacterial surface is advantageous and these new plastics materials will be particularly advantageous in whirlpool bath assemblies.

In one embodiment of the invention the pump has an impeller, the blades of which are so configured that water drains from each impeller to the drain-off valve in the stationary position. This is a relatively simple modification to a pump impeller which when done appears to be relatively obvious, but it is typical of the type of feature urgently required in such whirlpool bath assemblies.

Further there is provided an air fan having an outlet connected to each system pipe. By using an air fan it is now possible to totally dry out the system.

In another embodiment of the invention the whirlpool bath assembly comprises an air fan having an outlet connected to each system pipe and a control unit having means for sensing the cessation of water flow in the system pipes and means for operating the fan for a preset time to drive out any water retained on the surfaces of the assembly. Obviously automatic operation of the fan is desirable, particularly as cold air will be driven through the system any moist air that will be in the system will be driven out with the cold air and the surfaces of the system pipes will be dried off.

In a still further embodiment of the invention there is provided a control unit having:

means for sensing the cessation of water flow in the pipe; and means for causing the pump unit to continue to operate for a preset time to dry out the pump.

It is ideal that the pump continues to run for some time after there is no water in it, so that all water on any impeller blade will be thrown by centrifugal force out the pump onto its sidewalls and then there will be a movement of air which will further assist in the removal of water from the sidewalls of the pump down into the drain-off valve.

Further the invention provides a whirlpool bath assembly comprising:

a venturi jet unit including a two part main body namely an inner body part and an outer body part, the inner body part having a collar formed thereon for abutting against the interior side wall of a bath around a hole therein through which the inner body part may project, a bore in the inner body part communicating with a bore in the outer body part to form an elongate main bore, an elongate feeder bore in the outer body part extending from a water inlet and being at substantially right angles to the main bore and an air duct in the outer body part the bore of which is substantially at right angles to the main bore, venturi mounting means for securing the main body to the bath sidewall whereby the height of all surfaces contactable by water and over which water would flow on shutting off operation of the assembly reduce continuously in the direction of such flow without forming any water retaining pockets, a pump recirculation unit having an outlet and an inlet the surfaces of the pump being so arranged so that water will flow on shut-off by gravity from outlet to inlet without lodging in any recesses, a system suction pipe having an inlet for mounting in the bath and an outlet for feeding the pump inlet, the pipe sloping downwards from inlet to outlet without the formation of water retaining recesses, a system feed pipe between the water supply inlet of the venturi jet unit and the outlet of the pump recirculation unit, the feed pipe configured to drain into either the venturi unit or the pump recirculation unit on shutting off of the whirlpool assembly, the configuration being such as to further avoid the formation of water retaining recesses, a drain-off valve connected to the pump recirculation unit; and a waste-water pipe connecting the drain off valve to a bath waste-water drain in the waste-water pipe sloping downwardly from the drain-off valve to the bath waste-water drain without the formation of water retaining recesses.

This particular construction of unit is particularly easy to fit, will allow the optimum sizes of bores, etc. to be used, while at the same time requiring the minimum size of hole to be drilled in the bath sidewall.

In this latter embodiment of the invention the angle subtended by the straight bore of the venturi and the bath sidewall is between 15° and 50°.

For this particular embodiment of the invention, whirlpool bath assembly comprises:

a ball-shaped outlet jet for mounting on the venturi main body adjacent the outlet having a central passageway for communicating with the elongate bore; and a downwardly inclined drain-off passageway connecting the elongate bore to the bath.

Further the drain-off valve for this latter embodiment of the invention comprises;

a valve body having an upper inlet bore connected to the suction pipe and a lower outlet bore connected to the waste-water pipe;

a valve disc movable between a position closing the inlet to a position closing the outlet;

biasing means for urging the valve disc into the position closing the inlet;

a drain-off channel in the valve body communicating between the inlet bore and the interior of the valve body above the valve disc; and a drain-off hole through the disc defining a water passageway between the inlet bore and the outlet when the disc is in its position closing the inlet bore and sealing against the valve body when the disc is in its position closing the outlet bore.

Ideally all water and air contacting surfaces are on components of a plastics material incorporating an anti-bacterial agent.

In this particular embodiment of the invention the pump has an impeller, the blades of which are so configured that water drains from each impeller to the drain-off valve in the stationary position.

Further there is provided an air fan having an outlet connected to each system feed pipe and a control unit having means for sensing the cessation of water flow in the system pipes and means for operating the fan for a preset time to drive out any water retained on the surfaces of the assembly.

The invention further provides a whirlpool bath assembly comprising:

a venturi jet unit including a main body having an elongate bore between the water supply inlet and a combined water and air supply outlet, a venturi throat of restricted cross-sectional area within the bore, an air duct feeding between an air inlet and outlet in the venturi throat, venturi mounting means for securing the main body to the bath sidewall, whereby the height of all surfaces contactable by water and over which water would flow on shutting off operation of the assembly reduce continuously in the direction of such flow without forming any water retaining pockets, a pump recirculation unit having an outlet and an inlet the surfaces of the pump being so arranged so that water will flow on shut-off by gravity from outlet to inlet without lodging in any recesses, a system suction pipe having an inlet for mounting in the bath and an outlet for feeding the pump inlet, the pipe sloping downwards from inlet to outlet without the formation of water retaining recesses, a system feed pipe between the water supply inlet of the venturi jet unit and the outlet of the pump recirculation unit, the feed pipe configured to drain into either the venturi unit or the pump recirculation unit on shutting off of the whirlpool assembly, the configuration being such as to further avoid the formation of water retaining recesses, a drain-off valve connected to the pump recirculation unit, a waste-water pipe connecting the drain off valve to a bath waste-water drain in the waste-water pipe sloping downwardly from the drain-off valve to the bath waste-water drain without the formation of water retaining recesses, an air fan connected to each system feed pipe; and a control unit having means for sensing the cessation of water flow in the pipe and means for operating the fan for a preset time to drive out any water retained on the surfaces of the assembly.

The great advantage of this latter embodiment is that the operation is automatic and all questions ensuring that the unit will be totally dried out are taken out of the user's hands and are provided automatically.

In this latter embodiment of the invention the whirlpool bath assembly comprises;

a ball-shaped outlet jet for mounting on the venturi main body adjacent the outlet having a central passageway for communicating with the elongate bore; and a downwardly inclined drain-off passageway connecting the elongate bore to the bath;

and the control unit may comprise:

means for sensing the cessation of water flow in the pipe; and means for causing the pump unit to continue to operate for a preset time to dry out the pump.

Further the invention provides a hole cutter of the type comprising an annularly arranged hole cutter blade and means for rotating the cutter blade characterised in that a pilot hole engaging spindle is concentrically arranged within the cutter blade.

In this latter embodiment of the invention the spindle includes means for securing it behind the pilot hole on the opposite side of the cutter blade.

Ideally the spindle is threaded adjacent its free end for engagement with a backing plate behind the pilot hole.

In one embodiment of the invention the spindle has a pair of longitudinally arranged wing members pivotally mounted on its free end and spring biased outwards and means for securing the spindle rigidly in position in the pilot hole.

In a still further embodiment of the invention the means for rotating the cutter blade comprises a gear box having a power input shaft for connection to a hand-held electric drill.

Preferably the power input shaft is transversely arranged with respect to the cutter blade and spindle and in which means are provided for moving the cutter blade axially relative to the spindle.

BRIEF DESCRIPTION OF THE DRAWINGS

The invention will be more clearly understood from the following description of an embodiment thereof given by way of example only with reference to the accompanying drawings in which.

DESCRIPTION OF THE PREFERRED EMBODIMENTS

Figure 1:
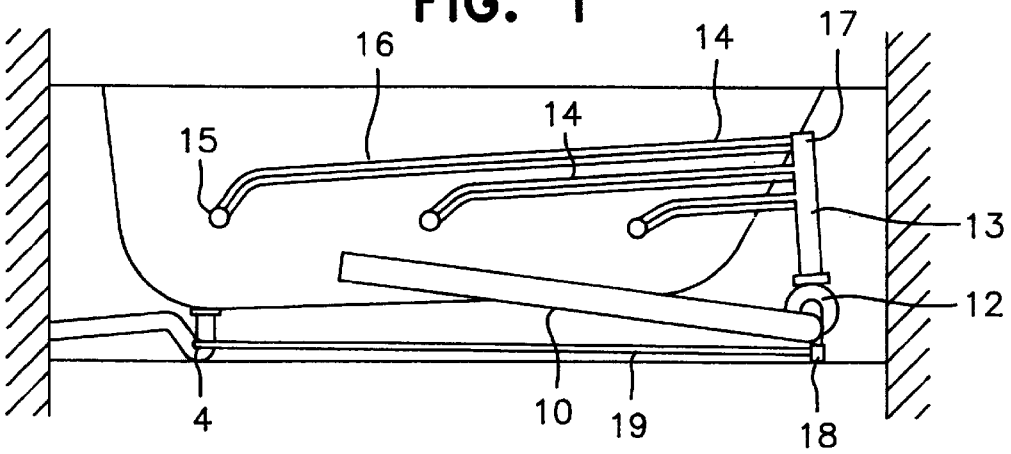
FIG. 1 is a side view of a bath incorporating a whirlpool assembly according to the invention, hereinafter a whirlpool bath.
Figure 2:
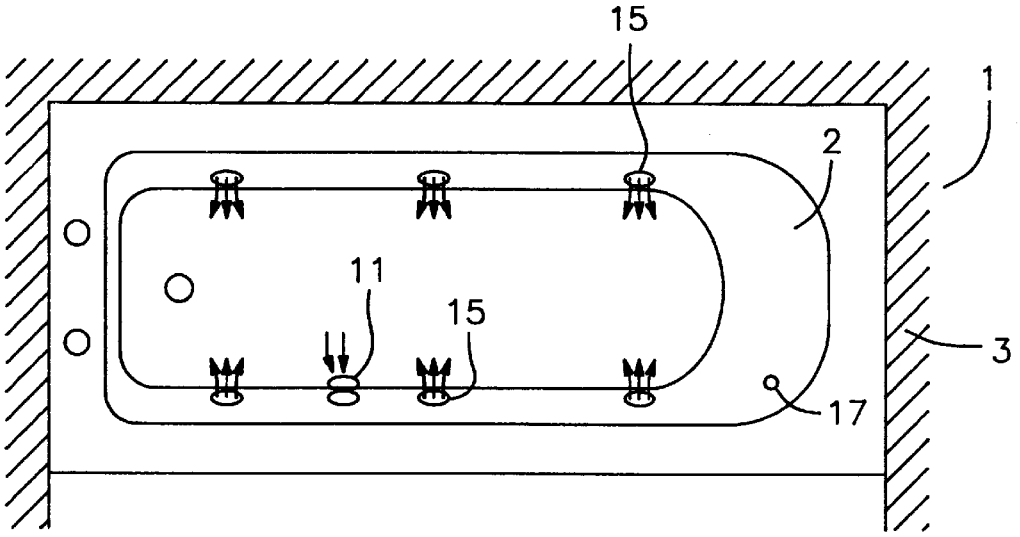
FIG. 2 is a plan view of the whirlpool bath.
Figure 3:
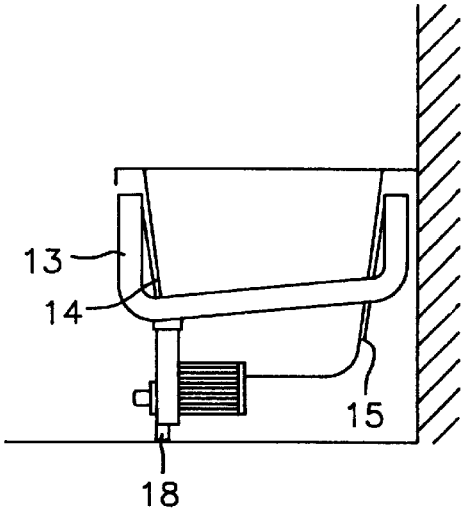
FIG. 3 is an end view of the whirlpool bath.

Referring to the drawings and initially to FIGS. 1 to 3, the invention will be described in broad outline. FIGS. 1 to 3 illustrate a whirlpool bath identified generally by the reference numeral 1 comprising a whirlpool assembly according to the invention mounted on a bath 2. The bath 2 is illustrated mounted between the walls of a bathroom, identified by the reference numeral 3, and incorporates a conventional waste water drain 4. A suction pipe 10 incorporating a water suction inlet device feeds a water circulation pump 12 forming part of a water recirculation unit which in turn feeds a water manifold 13 and system feed pipes 14, each of which terminates in a venturi jet unit 15. Each venturi jet unit 15 is connected by further pipes 16 to air control means 17 mounted in the side wall of the bath 2. The pump 12 is connected through a self-cleaning pump drain-off valve 18 and waste-water pipe formed by a drain pipe 19 to the waste-water drain 4. It should be noted that there are no bends in any of the piping where waste water can lodge.

Figure 4:
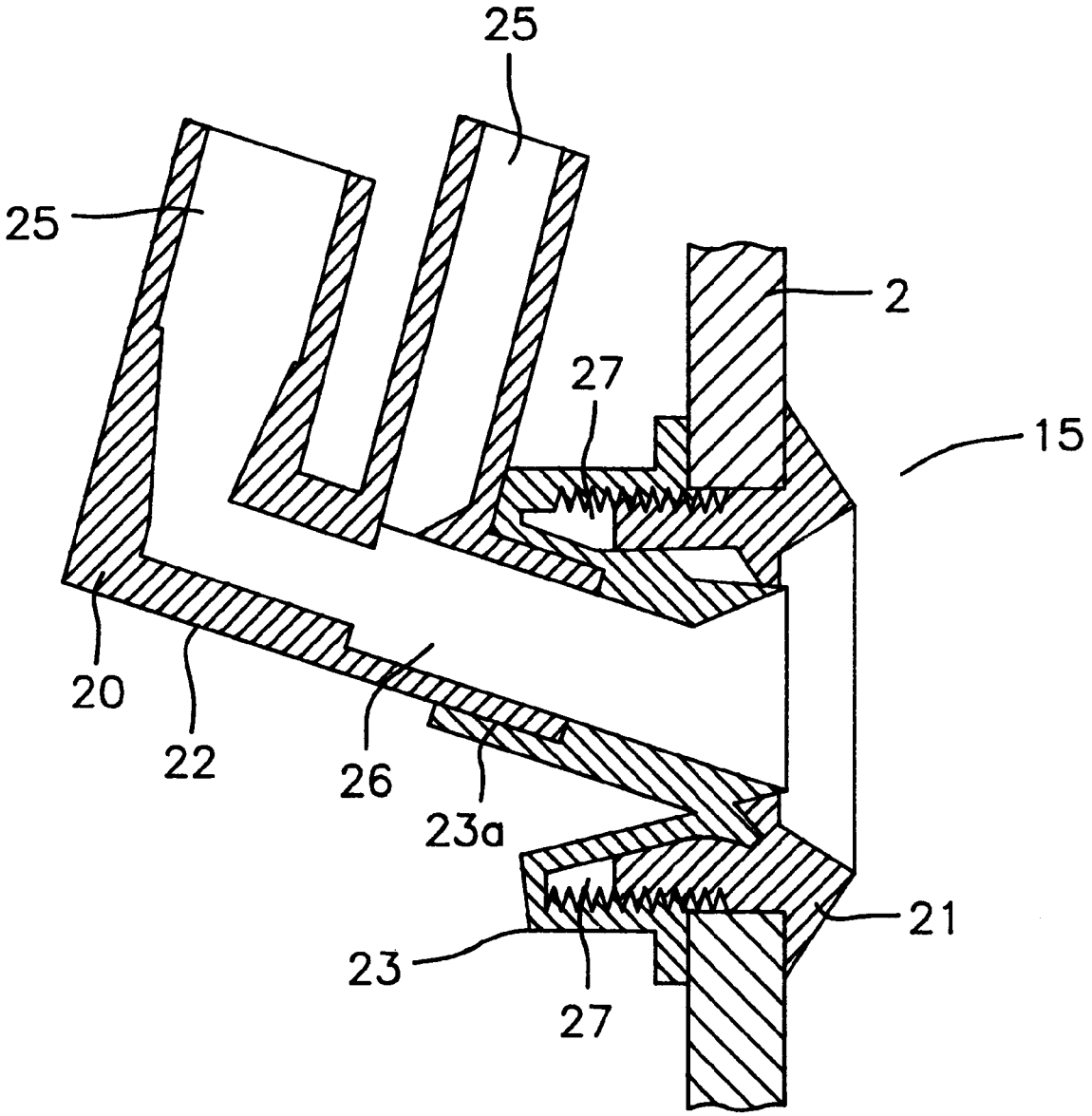
FIG. 4 is a sectional view of a venturi assembly fitted to a bath.
Figure 7:
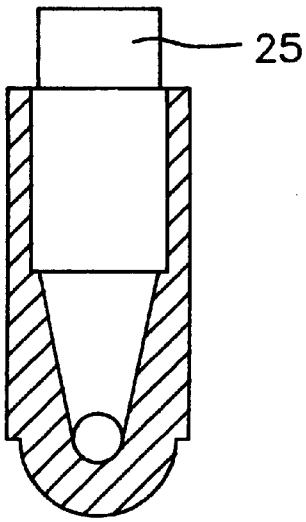
FIG. 7 is a sectional view along the lines VII—VII of FIG. 5.
Figure 6:
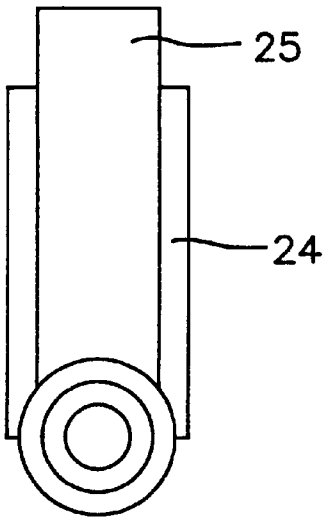
FIG. 6 is an end view of the portion of the assembly illustrated in FIG. 5.
Figure 5:
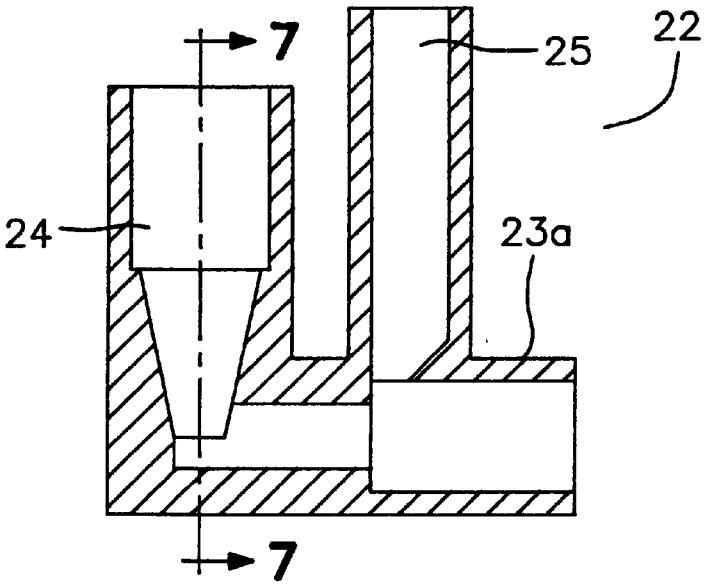
FIG. 5 is an identical sectional view of a portion of the whirlpool assembly of FIG. 4.
Figure 11:
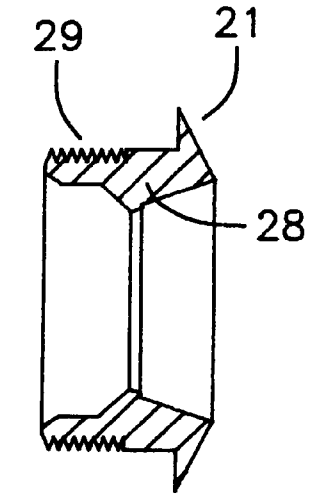
FIG. 11 is a sectional view along the lines XI—XI of FIG. 10, as also illustrated in FIG. 4.
Figure 10:
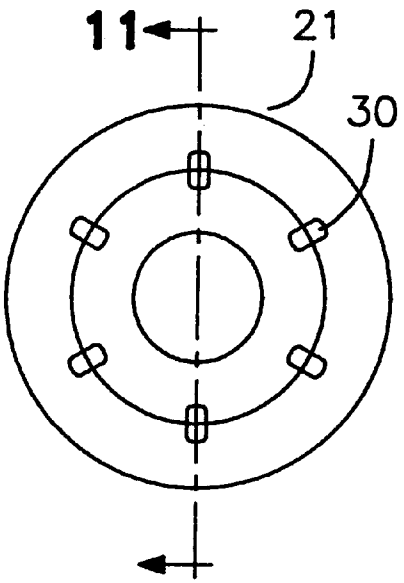
FIG. 10 is a front view of the clamp.
Figure 9:
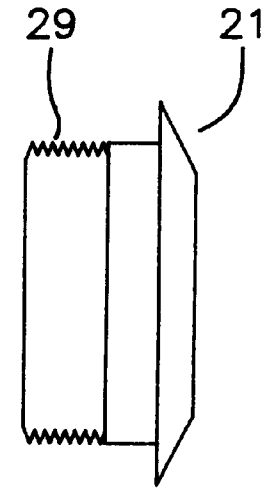
FIG. 9 is a side view of the clamp.
Figure 8:
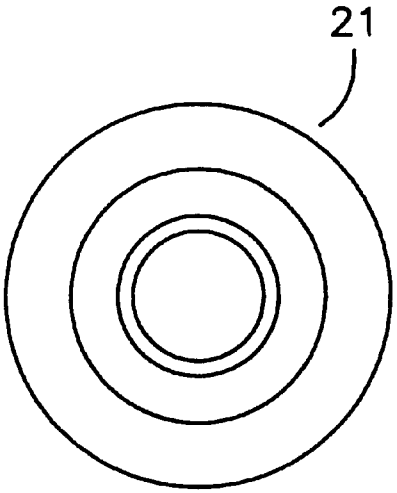
FIG. 8 is a rear view of a clamp forming part of the venturi assembly illustrated in FIG. 4.
Figure 15:
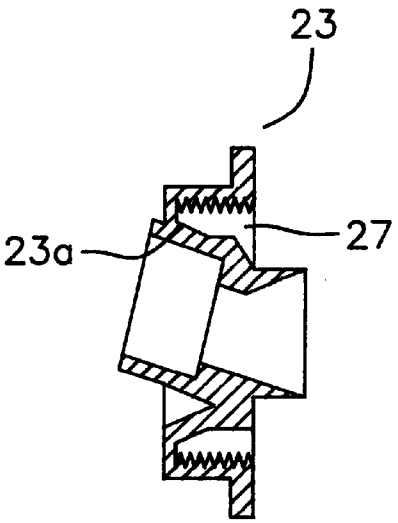
FIG. 15 is a sectional view in the direction of the arrows XV—XV of FIG. 14 and is identical to that portion illustrated in FIG. 4.
Figure 14:
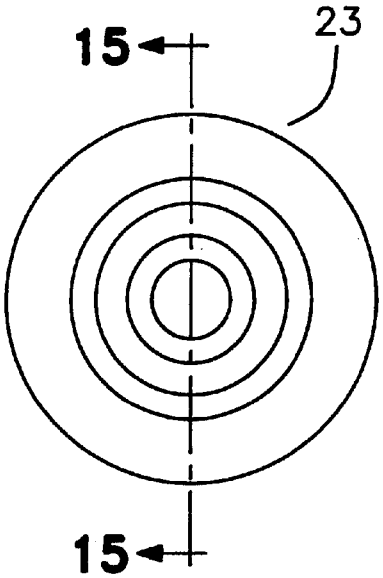
FIG. 14 is the other end view of the portion illustrated in FIG. 12.
Figure 13:
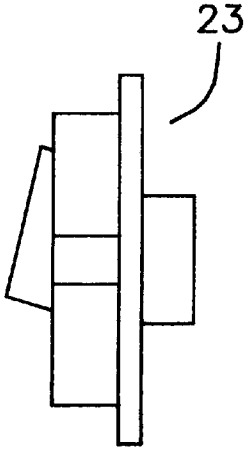
FIG. 13 is a side view of the portion of the venturi illustrated in FIG. 12.
Figure 12:
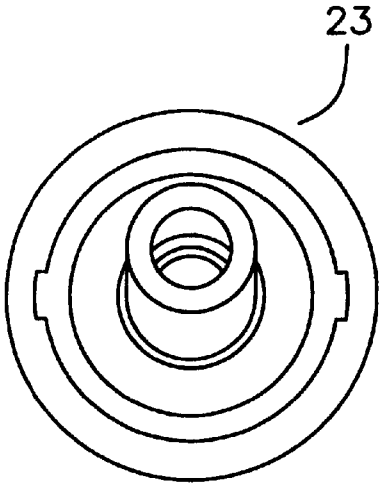
FIG. 12 is an end view of portion of the venturi assembly illustrated in FIG. 4.
Figure 18:
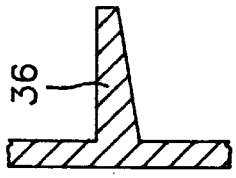
FIG. 18 is a cross-sectional view in the direction of the arrows XVIII—XVIII of FIG. 16.
Figure 17:
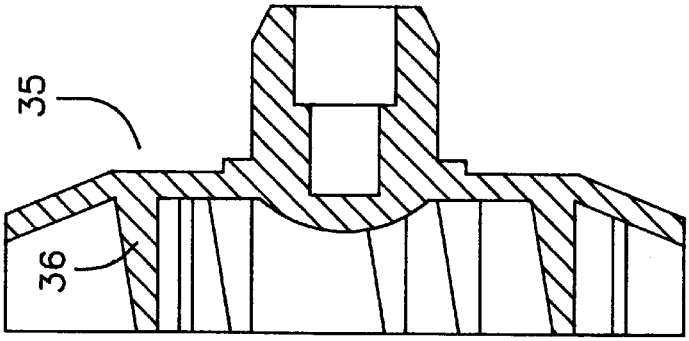
FIG. 17 is a sectional view in the direction of the arrows XVII—XVII of FIG. 16.
Figure 19:
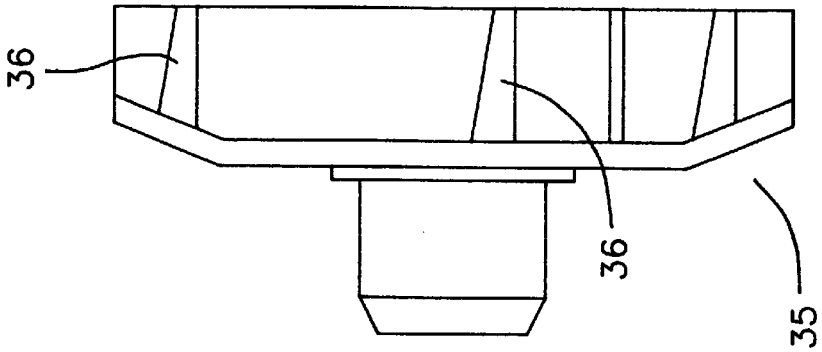
FIG. 19 is a side view of the impeller.
Figure 16:
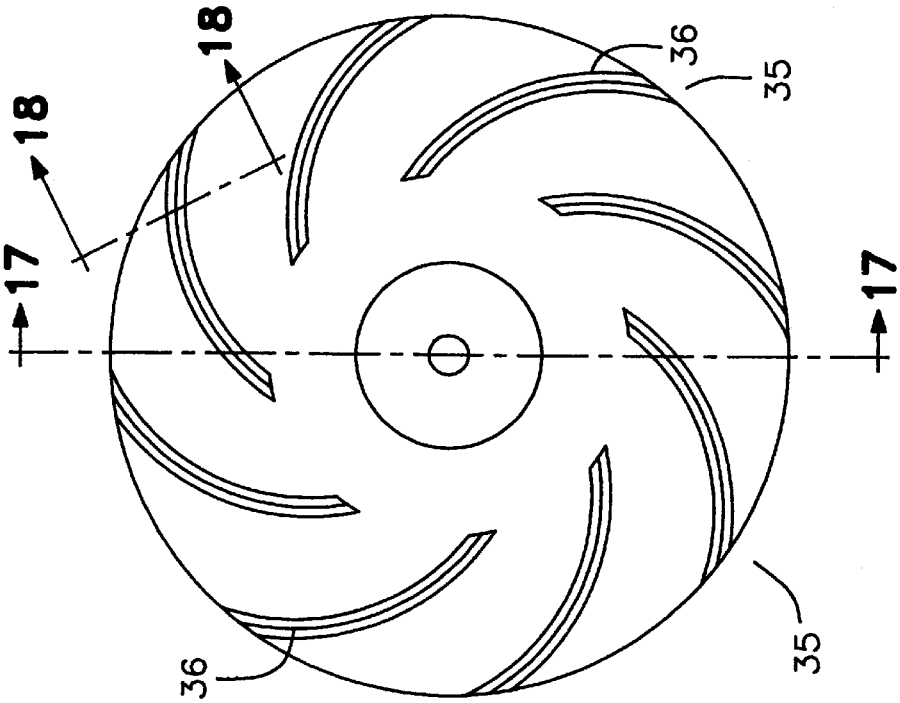
FIG. 16 is a front view of a pump impeller according to the invention.

Referring now to FIGS. 4 to 15 inclusive, and initially particularly to FIG. 4. The venturi jet unit 15 comprises a housing 20 secured to the bath 2 by clamping means formed by a clamp 21. The housing 20 is a two-part housing as can be seen from FIGS. 5 and 15 and comprises an outer body portion 22 and an inner body portion 23 secured together by a suitable adhesive at 23*a*. The housing 20 comprises a water inlet 24 and an air inlet 25 communicating with a main conduit 26 so-configured as to form a venturi. The inner body portion 23 of the housing 20 has a threaded annular recess 27 for reception of the clamp 21 see FIG. 15. The water inlet 25 and conduit 26 combine to form an elongate bore between water supply inlet and outlet, the water inlet 25 having an elongate feeder bore substantially at right angles to a main bore formed by the conduit 26.

Referring specifically to FIGS. 8 to 11 the clamp 21 is illustrated and comprises a bored cap 28 having threads 29 for engagement with the threaded annular recess 27. The bored cap 28 has recesses 30 for ease of fixing by use of a suitable tool. The assembly of the venturi jet unit 15 will be readily easily understood.

Referring now to FIGS. 16 to 19 there is illustrated a self-draining impeller indicated generally by the reference numeral 35 forming part of the water circulation pump 12. The impeller is a conventional centrifugal pump impeller, except that it has vanes 36 which are angled so as to let water run out of the pump.

Figure 20:
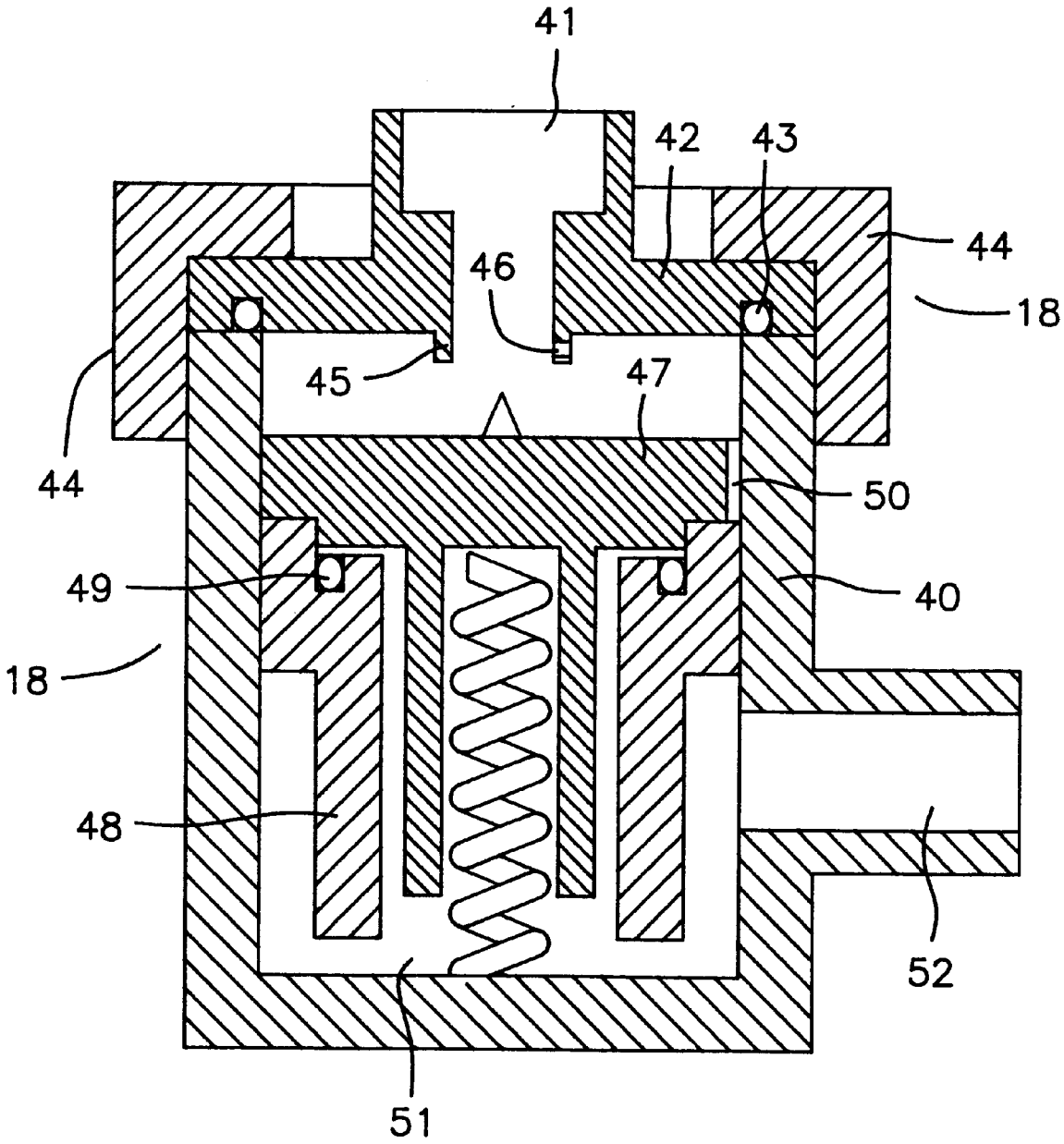
FIG. 20 is a typical cross-sectional view of a self-cleaning pump drain-off valve according to the invention.

Referring now to FIG. 20, there is illustrated the self-cleaning drain-off valve 18 which comprises a valve body 40 having an upper inlet bore 41 which is in turn connected to the suction pipe 10 not shown in this Figure. The bore 41 is incorporated in a cap 42 housing an o-ring 43 and secured to the valve body 40 by a threaded ring 44. There is provided a lip 45 which projects into the interior of the valve body 40. Part of the lip is cut-away to form a drain channel 46. A valve disc 47 is slidably mounted within a sleeve 48 mounted within the valve body 40. The sleeve 48 incorporates an o-ring 49 and it will be noted that it is spaced apart from the bottom of the valve body 40. The valve disc 47 has a drain-off hole 50 and is spring biased upwards by a spring 51. The valve body 40 has a lower outlet bore 52.

Any suitable control unit may be provided. There is nothing difficult or complex in providing the desired functionality. It is also envisaged that additionally a fan or blower may be provided.

In operation with the control unit, for example, the pump may be set to continue to rotate for some preset time such as five minutes after the water has drained from the system. Similarly, the fan, if provided, may be operated when the control unit senses cessation of water flow in the system pipes. The fan may then be operated to deliver cold air through the system pipes and thus drive out any water retained on the surfaces of the assembly. Obviously if the pump operates after the system has closed down, then any water still entrained within the pump will be delivered by centrifugal force over the impellers onto the side wall of the pump and then down into the drain off valve.

In operation, as with any conventional whirlpool bath, the water is drawn by the water circulation pump 12 out the water suction inlet device 11 through the suction pipe 10 into the water manifold 13 where it is then distributed under pressure through the pipes 14 to the various venturi jet units 15. The amount of air entrained within the venturi jet unit 15 is controlled by the air control means 17. When the unit is shut-off, the self-cleaning drain-off valve 18 opens and any water in the pump 12 will be delivered out of the drain-off valve 18 as will any water in the suction pipe 10 and even in portion of the water manifold 13 which will drain back into the pump 12. The remainder of the water will drain out through the pipes 14 into the various venturi jet assemblies to be delivered into the bath and from thence out the bath drain 4.

Considering now specifically the various units of the assembly such as, for example, the venturi jet unit 15 as illustrated in FIGS. 4 to 14, it will be noted and referring specifically to FIG. 4 that all the water in the water inlet 24 will drain out through the main conduit 26 into the bath 2.

Referring specifically to FIG. 20 the drain-off valve 18 is shown in the operating position i.e. in the position when the pump 12 is operating. When the pump 12 operates the pressure will be such as to force the valve disc 47 downwards, thus seating the valve disc against the o-ring 49 in the sleeve 48, No water will then be delivered out the outlet bore 51. However, when the pump is shut off there is no longer sufficient pressure to keep the valve disc 47 in the lowered position and the spring 50 will push the valve disc 47 upwards against the lip 45. However, any water gathering in the upper inlet bore 41 will bleed through the drain channel 46 and through the hole 50 into the valve body 40.

Figure 21:
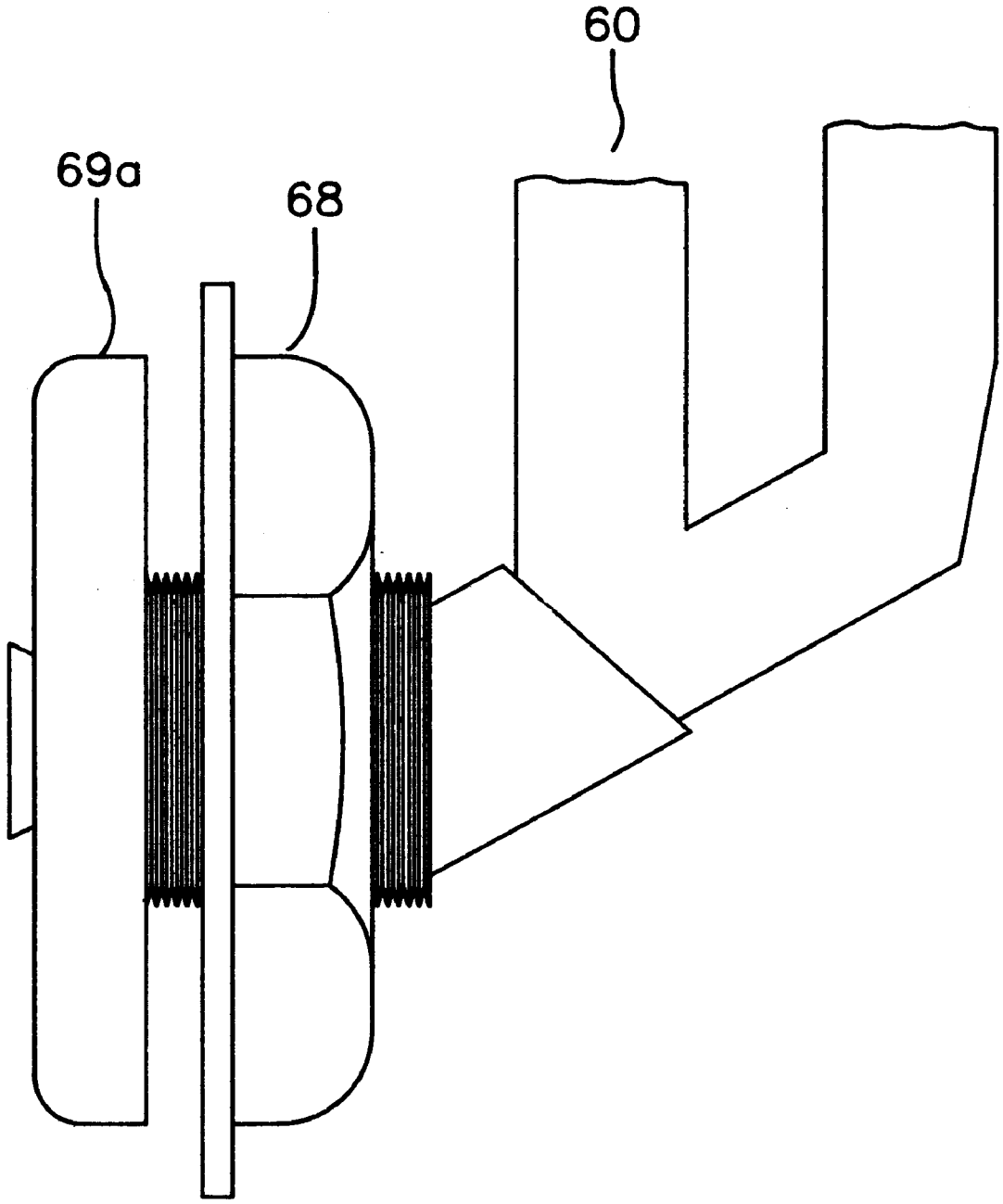
FIG. 21 is a side view of an alternative construction of venturi jet unit according to the invention.
Figure 22:
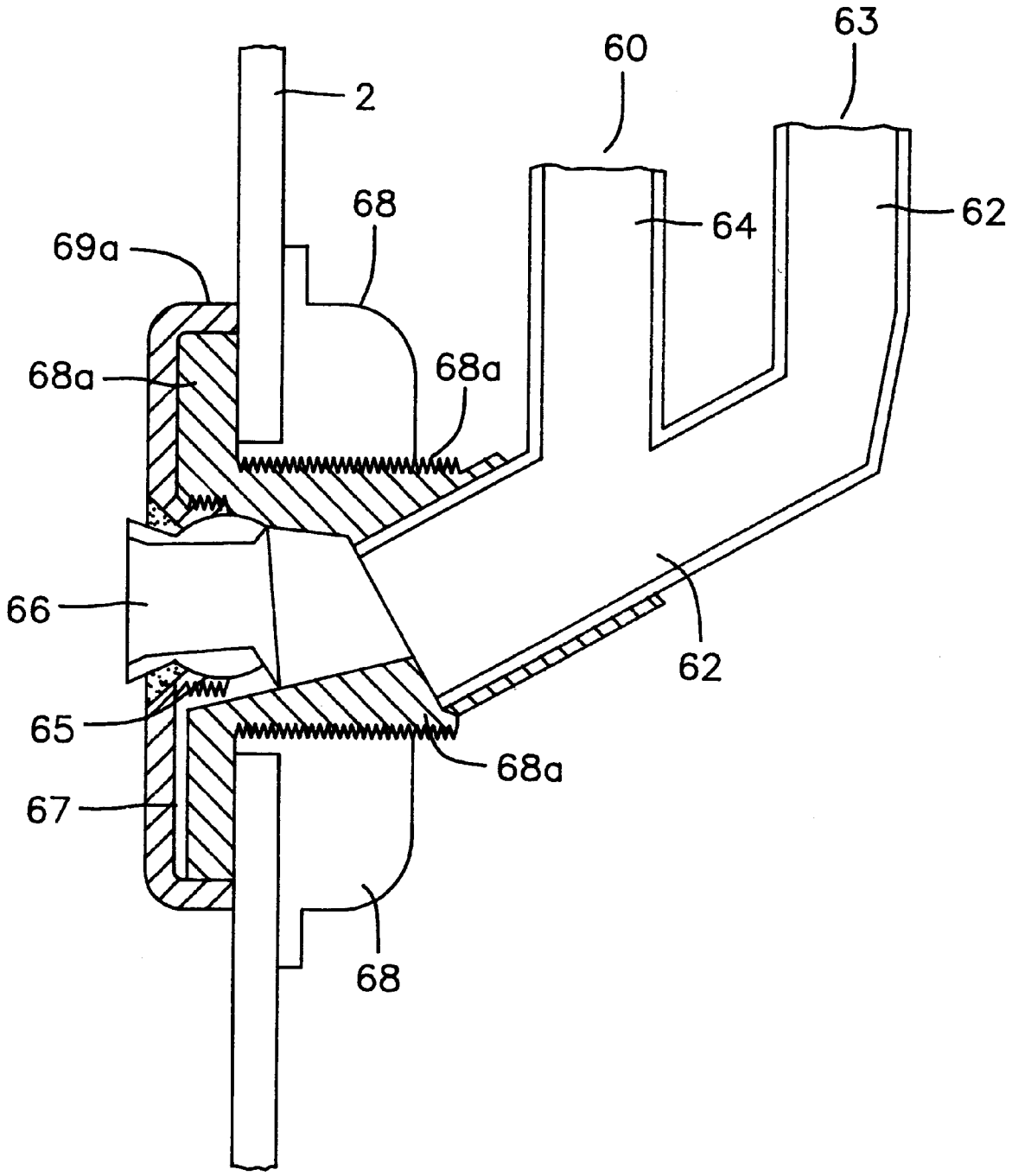
FIG. 22 is a typical sectional view of the venturi jet unit of FIG. 21.

Referring now specifically to FIGS. 21 and 22, there is illustrated an alternative construction of venturi jet unit, indicated generally by the reference numeral 60 in which parts similar to those described with reference to the previous drawings are identified by the same reference numerals. There is illustrated an elongated bore comprising a straight main bore 61 and a elongated feeder bore 62 having a water inlet 63 and an air duct 64. The main bore 61 is also enclosed by a ball-shaped outlet jet 65 adjacent the venturi outlet. The ball-shaped outlet jet 65 is of conventional construction and has a central passageway 66 which effectively forms an extension of the main bore 61 and thus of the total elongate bore. A downwardly directed drain-off channel 67 is provided between the main bore 61 and the bath. The mounting means for the venturi jet 60 comprises a collar 68*a* formed on the main body of the venturi jet unit 60 around the water supply outlet and a further collar 68 for mounting the main body against the bath side wall 2. A face plate 69*a* retains the ball-shaped outlet jet 65 and the collar 68 in position.

Figure 23:
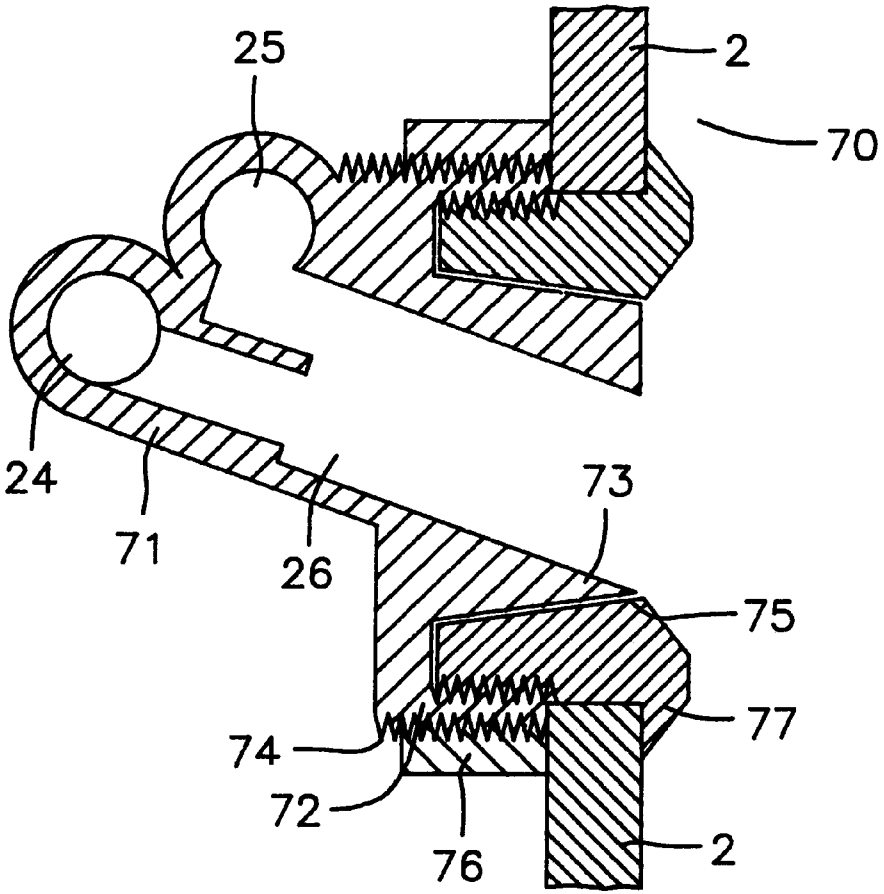
FIG. 23 is a sectional view of another construction of venturi jet unit according to the invention.

Referring to FIG. 23 there is illustrated an alternative construction of venturi jet unit indicated generally by the reference numeral 70 in which parts similar to those described with reference to the previous drawings are identified by the same reference numerals. In this embodiment the venturi jet unit 70 comprises a housing 71 including an integral mounting collar 72 which circumscribes and is spaced apart from an internal tapered surface 73 of the main conduit 26. Both an external surface 74 and an internal surface 75 are threaded for engagement with a back nut 76 and a front collar 77. The venturi jet unit 70 is installed by loosely threading the back nut 76 on the external surface 74 of the mounting collar 72, before positioning the venturi housing 71 against the external surface of the bath 2 so that the main conduit 26 projects into the opening in the bath 2. The front collar 77 is then screwed into position as can be seen from FIG. 23. Silicone sealant can be used on appropriate surfaces and in particular on the external tapered surface 73.

Figure 24:
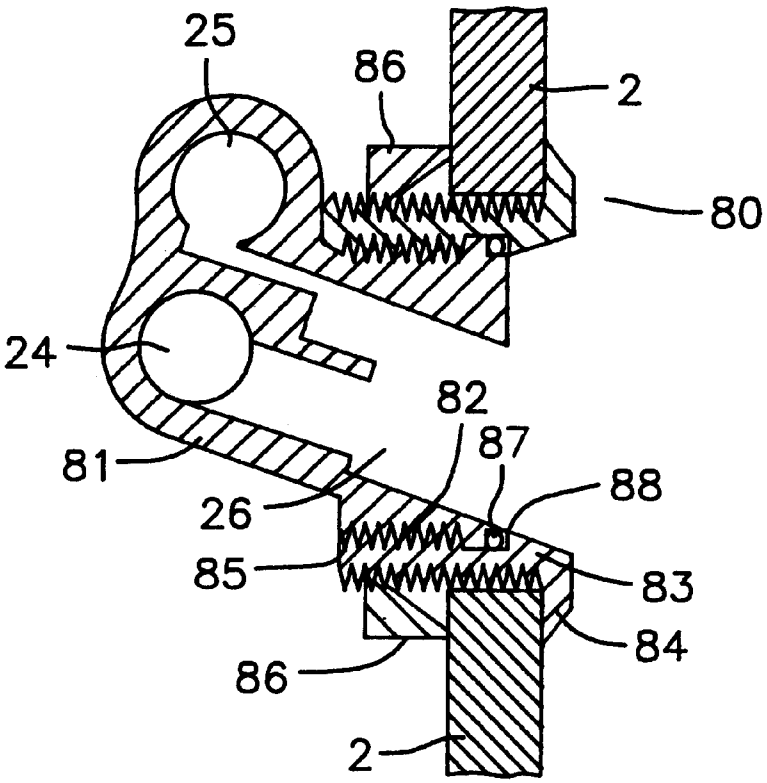
FIG. 24 is a sectional view of a still further construction of venturi jet unit according to the invention.

Referring to FIG. 24, there is illustrated an alternative construction of venturi jet unit indicated generally by the reference numeral 80 in which parts similar to those described with reference to the previous drawings are identified by the same reference numerals. In this embodiment the venturi unit 80 has a venturi housing 81 which is externally threaded at 82. In this embodiment there is provided an annular wall fitting 83 having a bath engaging collar 84 and a rearwardly projecting annular ring 85 which is threaded on both sides for engagement with the venturi housing 81 and the back nut 86 as can be seen from the drawing. The venturi housing 81 and the annular wall fitting 83 together combine to form a recess 87 in which is mounted an O-ring 88.

The advantage of the two-part construction becomes apparent when it is desired to keep the outlet jet into the bath as small as possible. At the same time the water inlet and the air inlet should be of a reasonably substantial construction. If one is to provide a unitary construction then a problem arises in trying to fit the venturi jet unit into the bath. Indeed a hole larger than is necessary must be cut in the bath sidewall to accommodate the whole venturi jet unit when it is of a unitary construction. With the two-part construction it is possible to clamp the first part of the venturi jet into position and then secure the inner body portion to the outer body portion by adhesive. For example the ideal size of face plate which is effectively the clamp should be of the order of 40 mm diameter. The extent of the elongate bore should be at least 30 mm and then if the inlets are to be of the order of 10 to 12 mm bore, it will be readily appreciated that such a unit could not be pushed through a hole in the bath which would be of sufficient small diameter to allow a face plate of 40 mm to be used.

Figure 25:
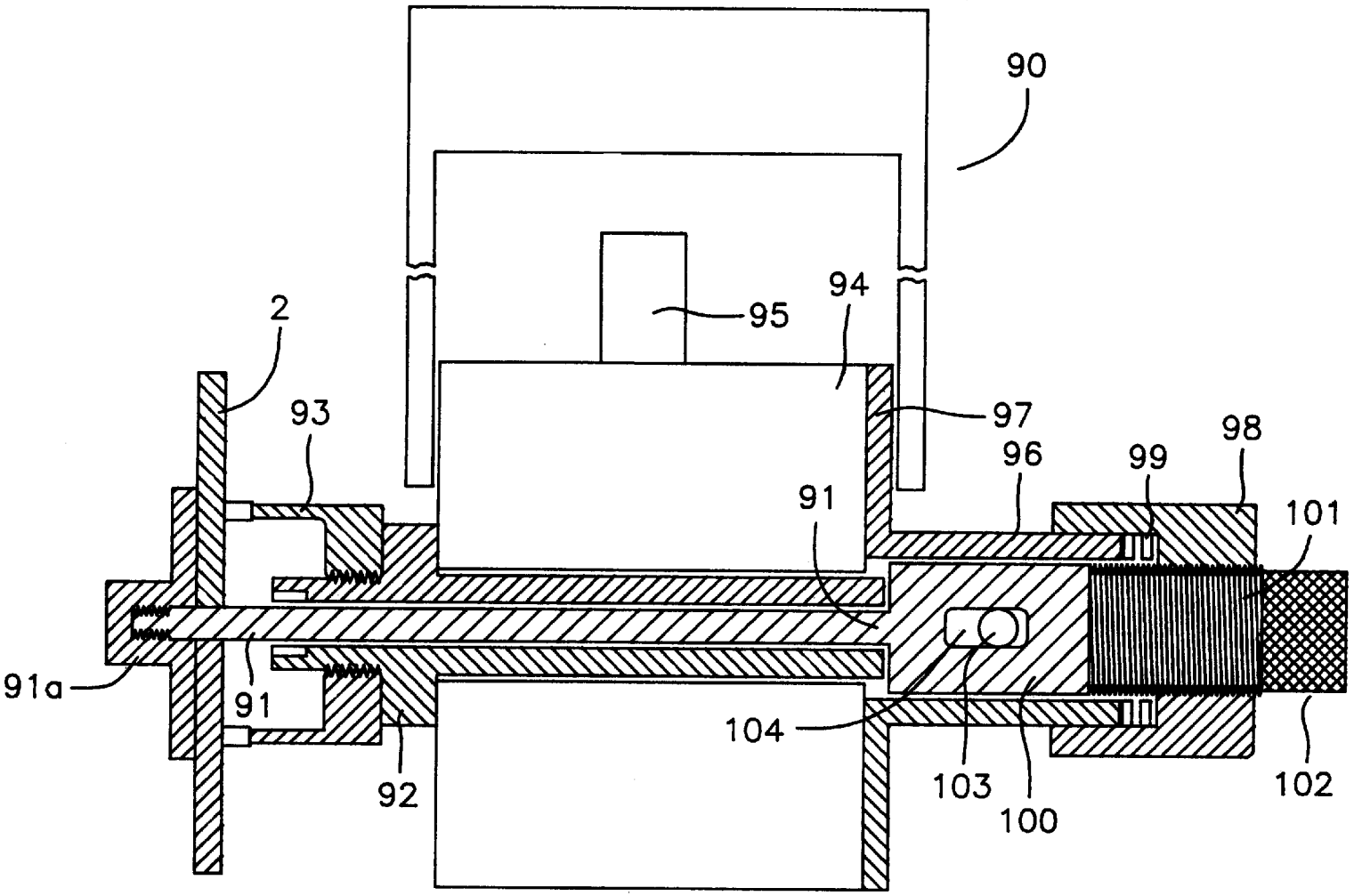
FIG. 25 is a typical part-sectional view of a hole cutter according to the invention.

Referring now to FIG. 25 there is illustrated a hole cutter which is particularly suitable for metal baths such as cast iron or steel baths. This is designed for drilling holes in situ. The hole cutter, indicated generally by the reference numeral 90, comprises a spindle 91 engaged within a pilot hole by a backing plate 91*a* and is concentric with and housed within a hole saw arbour 92 carrying a standard hole saw 93 driven by a transverse gear box 94 which in turn carries a power input shaft 95. The spindle 91 projects rearwardly into a tubular body member 96 having a flange 97 carrying the gear box 94 and also carrying a rotatable actuator 98 which is internally threaded. A thrust bearing 99 is interposed between the actuator 98 and the tubular body member 96. The spindle 91 carries an enlarged body portion 100 which is threaded at 101 and carries a knurled end knob 102 and is restrained from rotational movement within the tubular body member 96 by a transverse pin 103 within a slot 104.

The drill attachments 93 which is particularly suitable for drilling cast iron or steel baths in situ could be used for any situation where holes were required in steel panels, etc. has already been described. In operation a pilot hole is drilled in the bath wall 2 by a normal drill. The spindle 91 is then engaged within the backing plate 91*a* and the cutter is secured firmly in position. Then power, for example through a hand drill, is applied to the power input shaft 95 and the hole saw arbour 92 is driven as is therefore the hole saw 93. The actuator 98 is rotated forcing the hole saw 93 into the bath 2 until the hole is cut, when the hole saw 93 will press against the backing plate 91*a*. The advantage of this particular method is that it always maintains the hole saw square against the hole.

It will be appreciated that a particular advantage of the backing plate 91*a* is that it ensures that there will not be pressure on the saw and on the hole being cut to distort or damage the hole.

Figure 26:
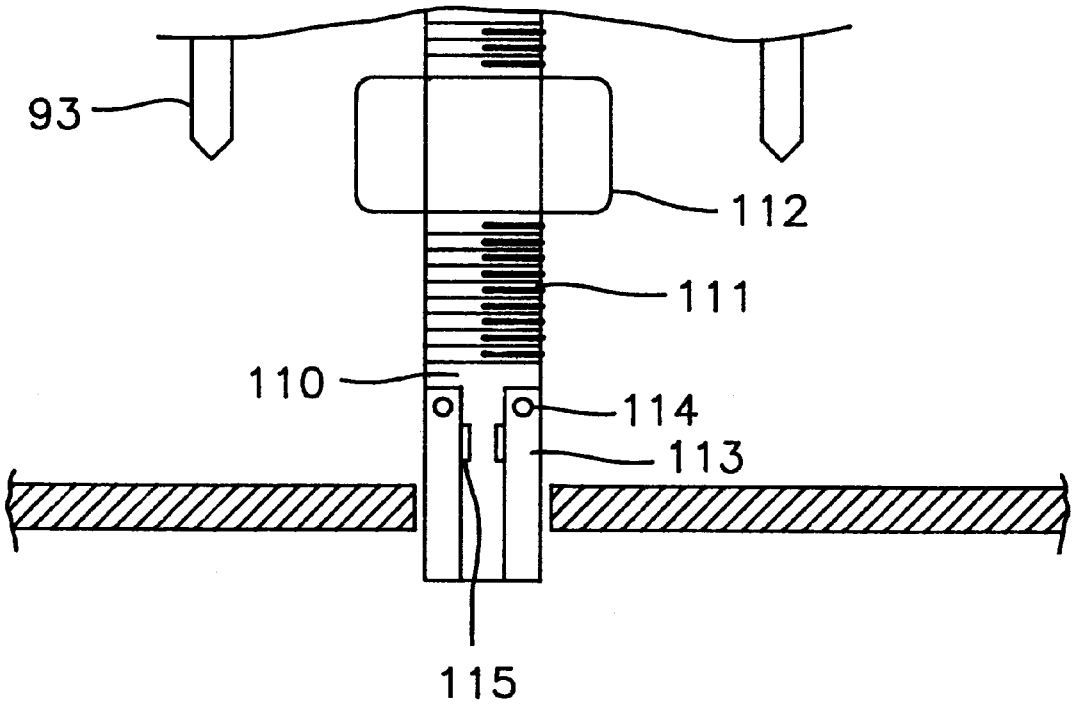
FIGS. 26 and 27 are sectional views of an alternative construction of spindle for use with a hole cutter such as illustrated in FIG. 25.
Figure 27:
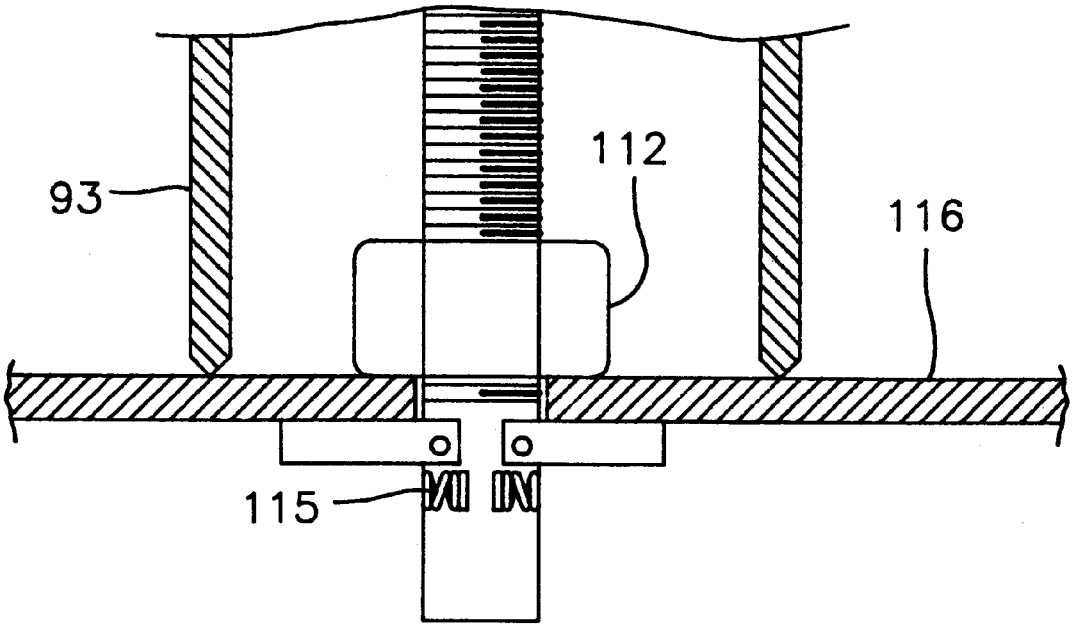

Referring now to FIGS. 26 and 27, there is illustrated an alternative construction of spindle identified by the reference numeral 110. In this embodiment the spindle 110 is threaded at 111 and carries a nut 112. Further the spindle has a pair of longitudinally arranged wing members 113 pivotally connected to the spindle by pins 114 and spring biased outwards by springs 115. In operation to insert the spindle 110 into a hole, the wing members are placed flush along the spindle 110 as illustrated in FIG. 26. Immediately the wing members 113 pass through the pilot hole, the wing members 113 will pivot out as illustrated in FIG. 27. The nut 112 is then tightened down onto the workpiece identified by the reference numeral 116.

It is envisaged that instead of a hole saw any cutter blade could be used. Further while in the embodiment described above the hole cutter has been illustrated as being an attachment for use with a drill, it could relatively easily combine its own drive means. This latter arrangement would be particularly suitable with the spindle illustrated in FIGS. 26 and 27.

It is envisaged that all components of the whirlpool unit into which water or air comes into contact be manufactured from a plastics material incorporating an anti-bacterial agent. These plastics materials would be extremely advantageous for use with the present invention.

The invention is not limited to the embodiment hereinbefore described which may be varied in both construction and detail within the scope of the claims.

We claim:

1. A whirlpool bath assembly comprising:

a venturi jet unit including a main body having an elongate bore between a water supply inlet and a combined water and air supply outlet, a venturi throat of restricted cross-sectional area within the bore, an air duct feeding between an air inlet and outlet in the venturi throat, venturi mounting means for securing the main body to a bath sidewall, whereby the height of all surfaces contactable by water and over which water would flow on shutting off operation of the assembly reduce continuously in the direction of such flow without forming any water retaining pockets, a pump recirculation unit having an outlet and an inlet the surfaces of the pump being so arranged so that water will flow on shutoff by gravity from outlet to inlet without lodging in any recesses, a system suction pipe having an inlet for mounting in the bath and an outlet for feeding the pump inlet, the pipe sloping downwards from inlet to outlet without the formation of water retaining recesses, a system feed pipe between the water supply inlet of the venturi jet unit and the outlet of the pump recirculation unit, the feed pipe configured to drain into either the venturi unit or the pump recirculation unit on shutting off of the whirlpool assembly, the configuration being such as to further avoid the formation of water retaining recesses, a drain-off valve connected to the pump recirculation unit, and a waste-water pipe connecting the drain off valve to a bath waste-water drain in the waste-water pipe sloping downwardly from the drain-off valve to the bath waste-water drain without the formation of water retaining recesses.

2. A whirlpool bath assembly as claimed in claim 1 in which the main body is a two part body one part comprising a collar for abutting around a mounting hole in the bath sidewall and projecting therethrough to form portion of the main bore, the remainder of the main body being formed by a part totally behind the bath sidewall.

3. A whirlpool bath assembly as claimed in claim 1 in which the angle subtended by the elongate bore of the venturi and the bath sidewall is between 15° and 50°.

4. A whirlpool bath assembly as claimed in claim 1 which comprises:

a ball-shaped outlet jet for mounting on the venturi main body adjacent the outlet having a central passageway for communicating with the elongate bore; and a downwardly inclined drain-off passageway connecting the elongate bore to the bath.

5. A whirlpool bath assembly as claimed in claim 1 in which the drain-off valve comprises:

a valve body having an upper inlet bore connected to the suction pipe and a lower outlet bore connected to the waste-water pipe;

a valve disc movable between a position closing the inlet to a position closing the outlet;

biasing means for urging the valve disc into the position closing the inlet;

a drain-off channel in the valve body communicating between the inlet bore and the interior of the valve body above the valve disc; and a drain-off hole through the disc defining a water passageway between the inlet bore and the outlet when the disc is in its position closing the inlet bore and sealing against the valve body when the disc is in its position closing the outlet bore.

6. A whirlpool bath assembly as claimed in claim 1 in which all water and air contacting surfaces are on components of a plastics material incorporating an anti-bacterial agent.

7. A whirlpool bath assembly as claimed in claim 1 in which the pump has an impeller, the blades of which are so configured that water drains from each impeller to the drain-off valve in the stationary position.

8. A whirlpool bath assembly as claimed in claim 1 comprising a control unit having:

means for sensing the cessation of water flow in the pipe; and means for causing the pump unit to continue to operate for a preset time to dry out the pump.

9. A whirlpool bath assembly comprising:

a venturi jet unit including a two part main body namely an inner body part and an outer body part, the inner body part having a collar formed thereon for abutting against an interior side wall of a bath around a hole therein through which the inner body part may project, a bore in the inner body part communicating with a bore in the outer body part to form an elongate main bore, an elongate feeder bore in the outer body part extending from a water inlet and being at substantially right angles to the main bore and an air duct in the outer body part the bore of which is substantially at right angles to the main bore, venturi mounting means for securing the main body to the bath sidewall whereby the height of all surfaces contactable by water and over which water would flow on shutting off operation of the assembly reduce continuously in the direction of such flow without forming any water retaining pockets, a pump recirculation unit having an outlet and an inlet the surfaces of the pump being so arranged so that water will flow on shut-off by gravity from outlet to inlet without lodging in any recesses, a system suction pipe having an inlet for mounting in the bath and an outlet for feeding the pump inlet, the pipe sloping downwards from inlet to outlet without the formation of water retaining recesses, a system feed pipe between the water supply inlet of the venturi jet unit and the outlet of the pump recirculation unit, the feed pipe configured to drain into either the venturi unit or the pump recirculation unit on shutting off of the whirlpool assembly, the configuration being such as to further avoid the formation of water retaining recesses, a drain-off valve connected to the pump recirculation unit; and a waste-water pipe connecting the drain off valve to a bath waste-water drain in the waste-water pipe sloping downwardly from the drain-off valve to the bath waste-water drain without the formation of water retaining recesses.

10. A whirlpool bath assembly as claimed in claim 9 in which the angle subtended by the straight bore of the venturi and the bath sidewall is between 15° and 50°.

11. A whirlpool bath assembly as claimed in claim 9 which comprises:

a ball-shaped outlet jet for mounting on the venturi main body adjacent the outlet having a central passageway for communicating with the elongate bore; and a downwardly inclined drain-off passageway connecting the elongate bore to the bath.

12. A whirlpool bath assembly as claimed in claim 9 in which the drain-off valve comprises:

a valve body having an upper inlet bore connected to the suction pipe and a lower outlet bore connected to the waste-water pipe;

a valve disc movable between a position closing the inlet to a position closing the outlet;

biasing means for urging the valve disc into the position closing the inlet;

a drain-off channel in the valve body communicating between the inlet bore and the interior of the valve body above the valve disc; and a drain-off hole through the disc defining a water passageway between the inlet bore and the outlet when the disc is in its position closing the inlet bore and sealing against the valve body when the disc is in its position closing the outlet bore.

13. A whirlpool bath assembly as claimed in claim 9 in which all water and air contacting surfaces are on components of a plastics material incorporating an anti-bacterial agent.

14. A whirlpool bath assembly as claimed in claim 9 in which the pump has an impeller, the blades of which are so configured that water drains from each impeller to the drain-off valve in the stationary position.

15. A whirlpool bath assembly as claimed in claim 9 in which there is provided an air fan having an outlet connected to each system feed pipe and a control unit having means for sensing the cessation of water flow in the system pipes and means for operating the fan for a preset time to drive out any water retained on the surfaces of the assembly.

16. A whirlpool bath assembly comprising:

a venturi jet unit including a main body having an elongate bore between a water supply inlet and a combined water and air supply outlet, a venturi throat of restricted cross-sectional area within the bore, an air duct feeding between an air inlet and outlet in the venturi throat, venturi mounting means for securing the main body to the bath sidewall, whereby the height of all surfaces contactable by water and over which water would flow on shutting off operation of the assembly reduce continuously in the direction of such flow without forming any water retaining pockets, a pump recirculation unit having an outlet and an inlet the surfaces of the pump being so arranged so that water will flow on shut-off by gravity from outlet to inlet without lodging in any recesses, a system suction pipe having an inlet for mounting in the bath and an outlet for feeding the pump inlet, the pipe sloping downwards from inlet to outlet without the formation of water retaining recesses, a system feed pipe between the water supply inlet of the venturi jet unit and the outlet of the pump recirculation unit, the feed pipe configured to drain into either the venturi unit or the pump recirculation unit on shutting off of the whirlpool assembly, the configuration being such as to further avoid the formation of water retaining recesses, a drain-off valve connected to the pump recirculation unit, a waste-water pipe connecting the drain off valve to a bath waste-water drain in the waste-water pipe sloping downwardly from the drain-off valve to the bath waste-water drain without the formation of water retaining recesses, an air fan connected to each system feed pipe; and a control unit having means for sensing the cessation of water flow in the pipe and means for operating the fan for a preset time to drive out any water retained on the surfaces of the assembly.

17. A whirlpool bath assembly as claimed in claim 16 which comprises:

a ball-shaped outlet jet for mounting on the venturi main body adjacent the outlet having a central passageway for communicating with the elongate bore; and a downwardly inclined drain-off passageway connecting the elongate bore to the bath.

18. A whirlpool bath assembly as claimed in claim 16 in which the control unit comprises:

means for sensing the cessation of water flow in the pipe; and means for causing the pump unit to continue to operate for a preset time to dry out the pump.

19. A whirlpool bath assembly comprising:

a venturi jet unit including a two part main body connected together to form a composite body including an inner body part and an outer body part, the inner body part having a collar formed thereon for abutting against an interior side wall of a bath around a hole therein through which the inner body part may project, a bore in the inner body part communicating with a bore in the outer body part to form an elongate main bore, an elongate feeder bore in the outer body part extending from a water inlet and being at an angle to the main bore and an air duct in the outer body part the bore of which is at an angle to the main bore, venturi mounting means for securing the main body to the bath sidewall whereby the height of all surfaces contactable by water and over which water would flow on shutting off operation of the assembly reduce continuously in the direction of such flow without forming any water retaining pockets, a pump recirculation unit having an outlet and an inlet the surfaces of the pump being so arranged so that water will flow on shut-off by gravity from outlet to inlet without lodging in any recesses, a system suction pipe having an inlet for mounting in the bath and an outlet for feeding the pump inlet, the pipe sloping downwards from inlet to outlet without the formation of water retaining recesses, a system feed pipe between the water supply inlet of the venturi jet unit and the outlet of the pump recirculation unit, the feed pipe configured to drain into either the venturi unit or the pump recirculation unit on shutting off of the whirlpool assembly, the configuration being such as to further avoid the formation of water retaining recesses, a drain-off valve connected to the pump recirculation unit; and a waste-water pipe connecting the drain off valve to a bath waste-water drain in the waste-water pipe sloping downwardly from the drain-off valve to the bath waste-water drain without the formation of water retaining recesses.

20. A whirlpool bath assembly as claimed in claim 19 in which the angle subtended by the straight bore of the venturi and the bath sidewall is between 15° and 50°.

21. A whirlpool bath assembly as claimed in claim 19 which comprises:

a ball-shaped outlet jet for mounting on the venturi main body adjacent the outlet having a central passageway for communicating with the elongate bore; and a downwardly inclined drain-off passageway connecting the elongate bore to the bath.

22. A whirlpool bath assembly as claimed in claim 19 in which the drain-off valve comprises:

a valve body having an upper inlet bore connected to the suction pipe and a lower outlet bore connected to the waste-water pipe;

a valve disc movable between a position closing the inlet to a position closing the outlet;

biasing means for urging the valve disc into the position closing the inlet;

a drain-off channel in the valve body communicating between the inlet bore and the interior of the valve body above the valve disc; and a drain-off hole through the disc defining a water passageway between the inlet bore and the outlet when the disc is in its position closing the inlet bore and sealing against the valve body when the disc is in its position closing the outlet bore.

23. A whirlpool bath assembly as claimed in claim 19 in which all water and air contacting surfaces are on components of a plastics material incorporating an anti-bacterial agent.

24. A whirlpool bath assembly as claimed in claim 19 in which the pump has an impeller, the blades of which are so configured that water drains from each impeller to the drain-off valve in the stationary position.

25. A whirlpool bath assembly as claimed in claim 19 in which there is provided an air fan having an outlet connected to each system feed pipe and a control unit having means for sensing the cessation of water flow in the system pipes and means for operating the fan for a preset time to drive out any water retained on the surfaces of the assembly.

* * * * *